United States Patent [19]

Wood

[11] Patent Number: 5,020,168

[45] Date of Patent: Jun. 4, 1991

[54] INFLATABLE HANDICAPPED CHAIR

[76] Inventor: Marsha B. Wood, 3610 Wentworth Dr., Arlington, Tex. 76017

[21] Appl. No.: 233,720

[22] Filed: Aug. 19, 1988

[51] Int. Cl.[5] ..... A47K 3/12

[52] U.S. Cl. ..... 4/573; 50/455

[58] Field of Search ..... 4/573, 575, 580–583, 4/572, 588; 5/455, 454, 453, 449, 441, 81 R

[56] References Cited

U.S. PATENT DOCUMENTS

| | | | |
|---|---|---|---|
| 1,235,669 | 8/1917 | Eggers | 5/455 X |
| 2,491,557 | 12/1949 | Goolsbee | 5/455 X |
| 2,582,439 | 1/1952 | Kavanagh | 4/575 X |
| 3,112,956 | 12/1963 | Schick et al. | 5/455 X |
| 3,499,682 | 3/1970 | Orenstein | 5/455 X |
| 3,705,429 | 12/1972 | Nail | 5/455 |
| 3,842,455 | 10/1974 | Whitney | 5/455 X |
| 3,909,859 | 10/1975 | Harris | 4/575 |
| 4,067,078 | 1/1978 | Winston | 5/455 |
| 4,338,691 | 7/1982 | Gaffney | 4/573 X |
| 4,484,781 | 11/1984 | Phelps | 5/455 X |
| 4,639,960 | 2/1987 | Quillen et al. | 5/455 |

FOREIGN PATENT DOCUMENTS

| | | | |
|---|---|---|---|
| 12775 | 7/1903 | Austria | 4/573 |
| 2263605 | 12/1972 | Fed. Rep. of Germany | 5/455 |
| 1161834 | 9/1958 | France | 5/455 |
| 1202100 | 1/1960 | France | 5/455 |
| 6511531 | 3/1966 | Netherlands | 5/455 |
| 1582332 | 1/1981 | United Kingdom | 5/455 |

*Primary Examiner*—Charles E. Phillips

*Attorney, Agent, or Firm*—Krass & Young

[57] ABSTRACT

An inflatable chain intended for use in bathing handicapped persons in a bathtube. The chair includes a base structure adapted to be supported on the bottom of the bathtub and a back structure connected to the base structure and adapted to be supported on an end wall of the bathtub. The back structure includes a plurality of individually inflatable portions to accommodate the particular configuration of the patient, the particular affliction of the patient, and the particular bathing operation being performed and the base structure has a similar plurality of individually inflatable sections for like purposes.

16 Claims, 2 Drawing Sheets

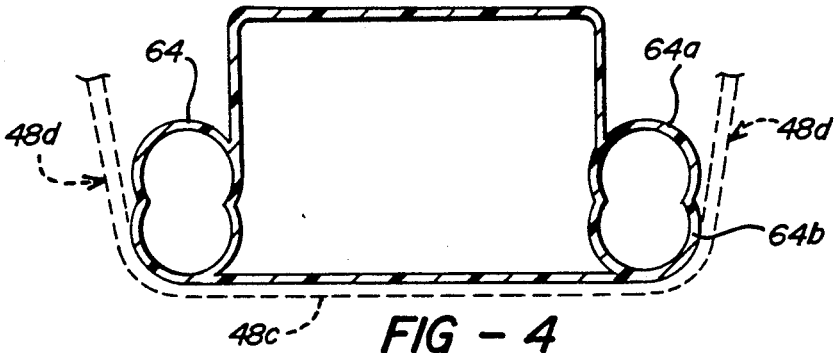
FIG - 4
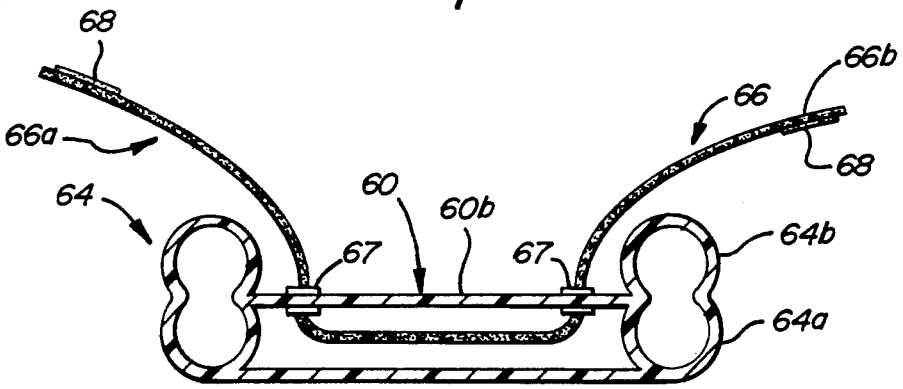
FIG - 5
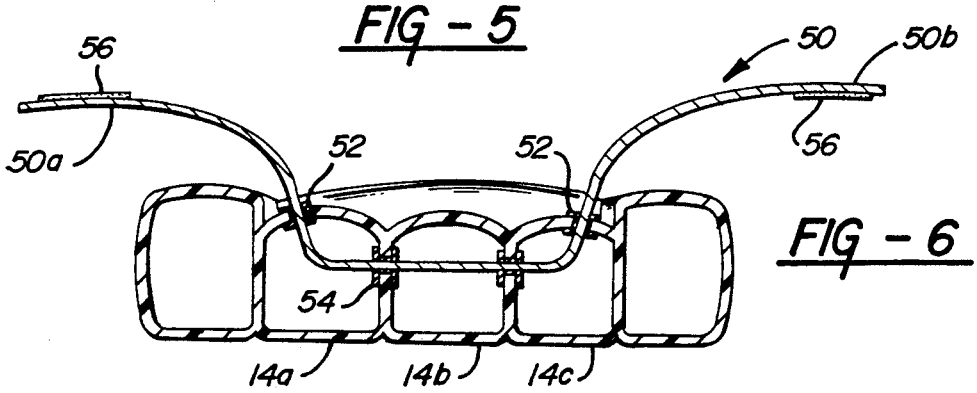
FIG - 6
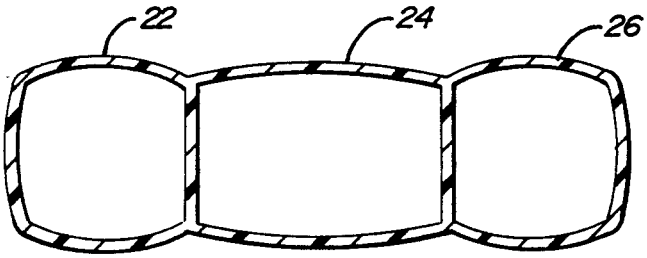
FIG - 7
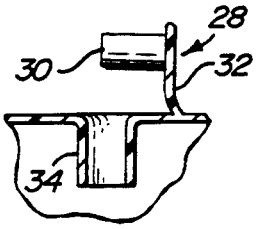
FIG - 8
FIG - 9
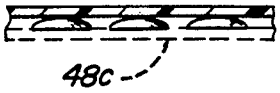

INFLATABLE HANDICAPPED CHAIR

INFLATABLE HANDICAPPED CHAIR

This invention relates to a device for assisting in the care of a handicapped person and more particularly relates to an inflatable chair intended for use in bathing a handicapped person in a bathtub.

Bathing a handicapped person, whether adult or child, is a difficult and time-consuming process since, depending upon the extent of the handicapped, the person being bathed requires considerable assistance in maintaining a proper attitude or posture within the bathtub to facilitate the bathing process and to ensure that the handicapped person is reasonably comfortable during the bathing process. Various attempts have been made to provide devices to facilitate the bathing of a handicapped person. In one such device, a water inflatable cushion is positioned in the tub to allow a wheelchair patient to slide conveniently onto the top of the inflated cushion whereafter the cushion is deflated to lower the patient into the bathtub. In another device, the patient, while remaining in bed, rolls over onto a deflated tub, the tub is thereafter inflated around the patient, and the tub is thereafter filled with water. In another device, which is also usable by able bodied persons, an inflatable pillow is positioned along the back and bottom of the bathtub to provide a comfortable support for the patient. Whereas all of these devices are effective for their limited, specific applications, none of them provide a simple and effective means for bathing a handicapped person in a standard bathtub.

SUMMARY OF THE INVENTION

This invention is directed to the provision of a device to facilitate the bathing of a handicapped person in a bathtub.

More specifically, this invention is directed to the provision of an inflatable chair which is positionable in a standard bathtub to facilitate the bathing of a handicapped person.

According to the invention, the chair comprises a base structure adapted to be supported on the bottom of the bathtub and including a plurality of individually inflatable sections, and a back structure connected to the base structure, adapted to be supported on an end wall of the bathtub, and including a plurality of individually inflatable sections. With this arrangement, the handicapped patient receives back and base support and the specifics of the back and base support may be tailored to the individual configuration and/or handicap of the person being bathed.

According to a further feature of the invention, the back structure includes a back support section extending upwardly from the base structure and an individually inflatable head support section. This arrangement allows the head of the patient to be selectively positioned by selective inflation of the separate head support section.

According to a further feature of the invention, the head support section includes a plurality of individually inflatable pillow portions arranged side-by-side at the top of the back support section. This arrangement allows the head of the patient to be individually and selectively positioned to accommodate a variety of bathing operations related to the head.

According to a further feature of the invention, the back structure further includes an inflatable lateral support section positioned at each side of the back support section and extending between the base structure and the head support section. This arrangement allows the lateral support along the back of the patient to be individually adjusted to accommodate the individual needs of the patient.

According to a further feature of the invention, each lateral support section includes a plurality of individually inflatable portions arranged serially between the base structure and the head support section. This arrangement allows the individual portions of each lateral support section to be selectively inflated to provide lateral back support tailored to a plurality of specific and different handicapped conditions relating to the back of the patient.

According to a further feature of the invention, the back support section is inflatable independently of the lateral support sections and the head support section. This arrangement allows the total back support structure to be individually and selectively inflated to specifically match the needs of the individual patient.

According to a further feature of the invention, the chair further includes a safety belt mounted on the back structure and arranged to extend across the chest of a user. This arrangement insures that the patient will be maintained in a secure position on the chair during the bathing process.

According to a further feature of the invention, the base structure includes a seat support section adjacent the lower end of the back structure and an inflatable knee support section adjacent the free end of the base structure. This arrangement allows the legs and knees of the patient to be carefully and selectively supported during the bathing process.

According to a further feature of the invention, the knee support section has a triangular configuration adapted to fit under and support the flexed knees of a user. This specific knee support structure maintains the legs and knees of the patient in a desirable flexed condition during the bathing process.

According to a further feature of the invention, the base structure further includes an individually inflatable U-shaped rim section extending along one side of the base structure, across the free end of the base structure, and back along the other side of the base structure to the back structure. This arrangement provides lateral support for the lower torso of the patient and provides structural rigidity for the base structure of the chair.

According to a further feature of the invention, the seat support section of the base structure is also inflatable. This arrangement provides further flexibility with respect to individually tailoring the chair to the specific needs of the patient.

According to a further feature of the invention, the seat support section includes a plurality of portions which are simultaneously inflatable.

According to a further feature of the invention, the back support section of the back structure and the seat support section of the base structures are simultaneously inflatable so as to simplify the inflation process.

According to a further feature of the invention, the chair further includes a second seat belt mounted on the base structure and adapted to extend around the pelvic region of the patient. This seat belt coacts with the seat belt on the back structure to insure that the patient is maintained in a secure position on the chair during the bathing process.

According to a further feature of the invention, the chair further includes ankle straps secured to the free end of the base structure and adapted to embrace the ankles of the patient. These ankle straps, in combination with the seat belts carried on the back structure and on the base structure, insure that the patient is securely and properly positioned on the chair during the bathing process.

BRIEF DESCRIPTION OF THE DRAWINGS

FIGS. 3, 4, 5, 6 and 7 are cross-sectional views taken respectively on lines 3–3, 4–4, 5–5, 6–6 and 7–7 of FIG. 1;

FIG. 8 is a detail view showing a value construction; and

FIG. 9 is a detail view showing a non-slip construction.

DETAILED DESCRIPTION OF THE PREFERRED EMBODIMENT

Figure 1:
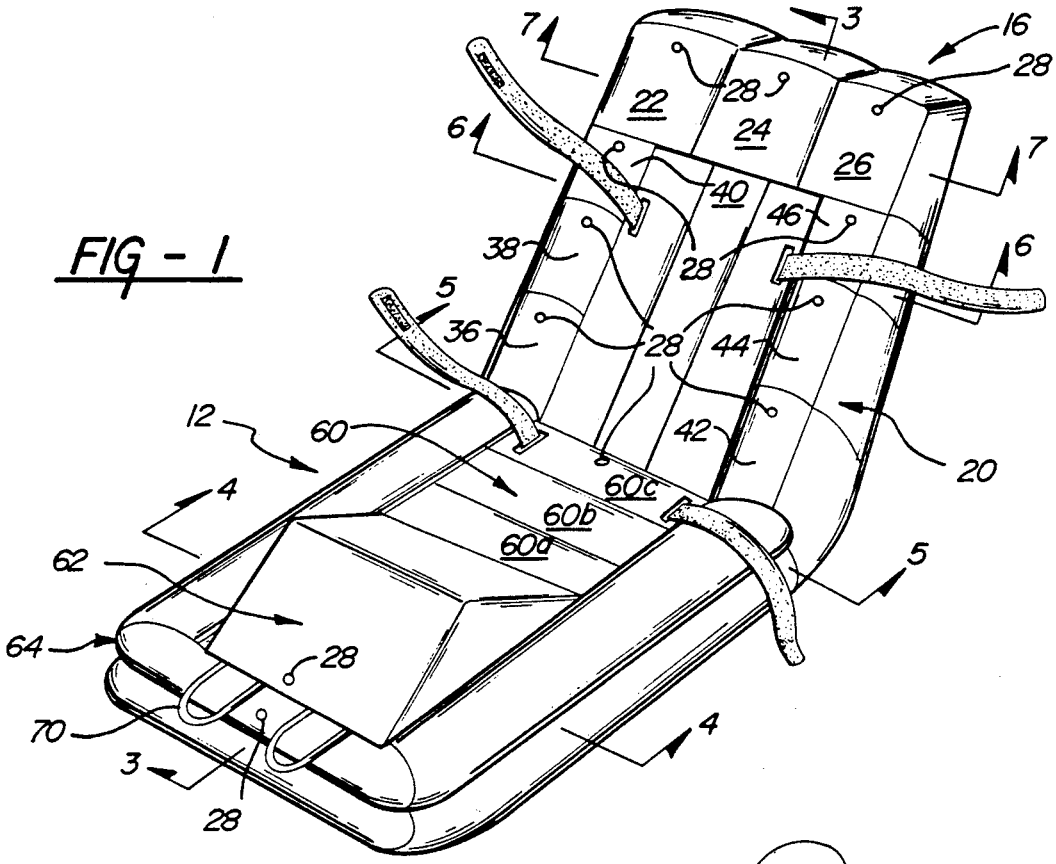
FIG. 1 is a perspective view of the invention chair.
Figure 2:
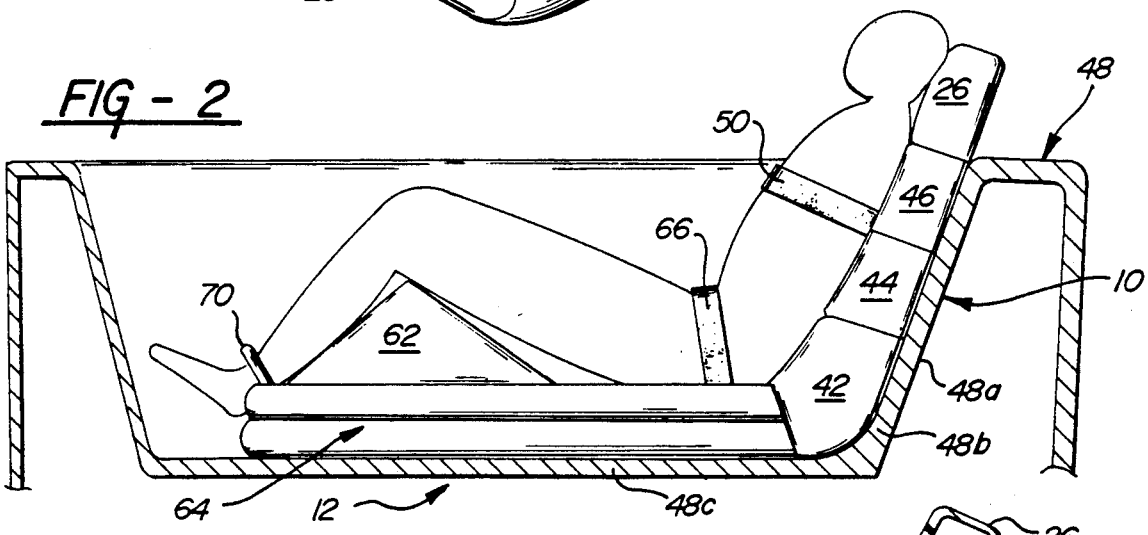
FIG. 2 is a view showing the invention chair positioned in a bathtub and with a patient positioned on the chair.

The invention chair is intended to be positioned in an inflated configuration in a standard bathtub, as seen in FIG. 2, and, broadly considered, includes a back structure 10 and a base structure 12. Both the back structure 10 and base structure 12 are formed of a suitable plastic material such for example as polyethylene. The material preferably has a thickness and structural integrity such that it will expand upon inflation to assume a predetermined configuration but will not stretch beyond the predetermined configuration once the predetermined configuration has been obtained with suitable inflation.

Back structure 10 includes a back support section 14, a head support section 16, and lateral support sections 18 and 20. Back support section 14 extends upwardly from base structure 12 and includes a plurality of side-by-side vertically extending parallel portions 14*a*, 14*b* and 14*c* which, while formed separately, are preferably simultaneously inflatable. Head support section 16 is positioned on top of back support section 14 and includes a plurality of individual pillow portions 22, 24, 26 arranged side-by-side at the top of the back support section 14. Each pillow portion 22, 24, 26 includes a separate valve assembly 28 so that the portions 22, 24, and 26 are individually inflatable.

Each valve assembly 28 is of known form and, as seen in FIG. 8, includes a plug member 30 carried by a live hinge member 32 and adapted to be positioned in a socket 34 so as to allow the associated pillow portion or section to be inflated by mouth or pump and then sealed by placement of plug 30 in socket 34. Alternatively, valve assemblies 28 may comprise other known forms and may, for example, comprise structures specifically adapted to be used with a hand pump and/or structures specifically adapted to be used with a source of pressurized air.

Lateral support sections 18, 20 are positioned respectively at opposite sides of back support section 14 and extend upwardly between base section 12 and head support section 16. Each lateral support section includes a plurality of individually inflatable portions arranged serially between the base structure and the head support section and oriented transverse to said upward extent. Specifically, lateral support section 18 includes a plurality of serially arranged portions 36, 38 and 40 and lateral support section 20 includes a plurality of serially arranged portions 42, 44 and 46. Each portion of each lateral support section includes its own valve assembly 28 so as to be individually and selectively inflatable.

Figure 3:
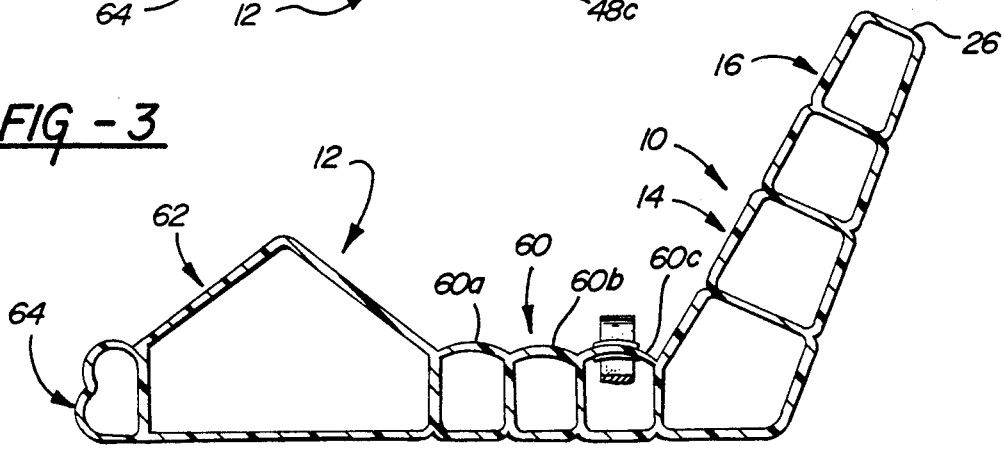

As best seen in FIGS. 2 and 3, the individual portions of each lateral support section 18, 20 are selectively configured to match the contour of the end wall 48*a* of the bathtub 48 with the lower portions 36, 42 having a configuration specifically tailored to fit the bathtub corner portion 48*b* formed at the juncture of end wall 48*a* and bathtub bottom wall 48*c*.

Back structure 10 further includes a seat belt 50 formed of a suitable fabric or plastic material and passing through grommets 52 provided in back section portions 14*a* and 14*c* and through further grommets 54 provided in the partitions separating the back section portions 14*a*, 14*b* and 14*c*. The ends 50*a* and 50*b* of the seat belt are provided with coacting Velcro members 56 to facilitate attachment of the ends 50*a*, 50*b* after the belt has been passed around the chest of the patient positioned in the chair.

Base structure 12 includes a seat support section 60, a knee support section 62 and a rim section 64.

Seat support section 60 includes a plurality of laterally extending portions 60*a*, 60*b* and 60*c* which, although formed separately and divided by lateral partitions, are simultaneously inflatable by a single valve assembly 28 positioned, for example, in seat support section portion 60*c*. The valve assembly 28 positioned in seat support section portion 60*c* is also preferably arranged to inflate portions 14*a*, 14*b* and 14*c* of back support section 14 so that back support section 14 and seat support section 16 may be simultaneously inflated.

Knee support section 62 is positioned adjacent the free end of the base structure and has a triangular configuration adapted to fit under and support the flexed knees of a user. Knee support section 62 is separately and individually inflated by its own valve assembly 28.

Rim section 64 extends from the bottom of back structure 10 along one side of the base structure, across the free end of the base structure forwardly of knee support section 62, and back along the other side of the base structure to the back structure. Rim section 64 thus has a U-configuration and is individually inflatable by its own valve assembly 28. Rim section 64 preferably has a FIG. 8 cross-sectional configuration with a lower portion 64*a* and an upper portion 64*b*. Upper portion 64*b* extends upwardly above seat support 60 so as to provide lateral support for the lower torso and upper legs of a user.

Base structure 12 further includes a seat belt 66 passing through grommets 67 in seat support section portion 60*c* and including Velcro members 68 on its opposite end 66*a* and 66*b* so as to facilitate securing the ends together after the ends have been passed around the pelvic region of a user.

Base structure further includes a pair of ankle straps 70 secured to the free end of the base structure adjacent the juncture of knee section 62 and the forward run of rim section 64 and adapted to embrace the ankles of a user positioned in the chair so as to coact with seat belts 50 and 66 to securely position the patient in the chair to facilitate the bathing operation.

Note, as best seen in FIG. 4, that the chair has a width approximating the width of a standard bathtub so that the parallel sides of rim section 64 are seated snugly against the sidewalls 48*d* of the bathtub to preclude lateral movement of the chair within the tub. The chair may of course be provided in various sizes to accommodate young children, adolescents, or adults and, in this respect, the width of the rim section 64 will vary depending upon the width of seat sections 60 and knee section 62 with the rim section, in any event, having a width which, when added to the width of the seat section 60 and knee section 62, approximates the total width of the bathtub so as to preclude lateral movement of the chair within the tub. The width of the individual sections of back structure 10 will also vary depending on the size of the intended user but the overall width of the back structure will preferably always match the overall width of the associated base structure.

Means are also desirably provided to otherwise preclude slippage of the base section relative to the bottom wall 48*c* of the tub. These means may comprise, for example, a suction cup configuration along the bottom wall of the base structure of the chair, as seen in FIG. 9 or, alternatively, the bottom wall of the base structure of the chair may be formed of a non-slip plastic material such for example Dycem available from Fred Simmons Inc. of Brookfield, Illinois.

The invention inflatable chair will be seen to provide many important advantages with respect to facilitating the bathing of a handicapped person. Specifically, the individual sections and/or portions of the chair may be selectively inflated to accommodate the particular configuration of the patient, or the particular affliction from which the patient is suffering. The various sections and portions may also be selectively inflated to facilitate various bathing operations. By way of example, but not by way of limitation, head sections 22 and 26 may be inflated and head portion 24 partially or wholly deflated to cradle the head and neck of a patient; head portions 22, 24 and 26 may all be deflated either partially or totally to allow the user's head and neck to be positioned rearwardly for shampooing purposes; lateral support sections 36, 44 and 40 may be inflated with partial or total deflation of the remaining lateral support sections to accommodate a patient afflicted with a scoliosis characterized by a left concavity; lateral support sections 42, 38 and 46 may be inflated with either partial or total deflation of the remaining lateral support sections to accommodate a patient suffering from a scoliosis characterized by a right concavity; all of the lateral support sections 36, 38, 40, 42, 44 and 46 may be inflated when it is desired to provide general lateral trunk support; and knee section 62 may be selectively inflated to provide the desired degree of knee flexure for the patient so as to counteract an extension pattern such for example as is exhibited in cerebral palsy patients. The invention chair thus facilitates the bathing of handicapped persons and may be specifically tailored to accommodate the particular affliction or the particular need of the patient. The chair may be readily and inexpensively manufactured since it incorporates only the use of readily available polyethylene material and may be constructed using known plastic forming technology. As previously indicated, the valve structure provided may vary depending upon the individual need and individual application and may be such as to facilitate mouth inflation, hand pump inflation, or inflation with a source of pressurized air.

Whereas a preferred embodiment of the invention has been illustrated and described in detail it will be apparent that various changes may be made in a disclosed embodiment without departing from the scope or spirit of the invention.

I claim:

1. An inflatable chair intended for use in bathing a handicapped patient in a bathtub, said chair comprising:

(A) a base structure adapted to be supported on the bottom of the bathtub and including a plurality of individually inflatable sections each defining a portion of the patient support surface of said base structure; and (B) a back structure connected to said base structure, adapted to be supported on an end wall of the bathtub, and including a plurality of individually inflatable sections together defining the patient support surface of said back structure and operative in response to selective inflation and deflation thereof to selectively inflate or deflate selected areas of said back support surface;

(C) said back structure including a back support section extending upwardly from said base structure, a head support section at the top of said back support section and an inflatable lateral support section positioned at each side of said back support section and extending between said base structure and said head support section with each lateral support section including a plurality of individually inflatable portions arranged serially between said base structure and said head support section.

2. An inflatable chair according to claim 1 wherein:

(D) said head support section is individually inflatable and said back support is inflatable independently of said lateral support sections and said head support section.

3. An inflatable chair according to claim 1 wherein:

(D) said chair further includes a safety belt mounted on said back structure and arranged to extend around the chest of a user.

4. An inflatable chair intended for use in bathing a handicapped person in a bathtub, said chair comprising:

(A) a back structure adapted to be supported against an end wall of the bathtub;

(B) a base structure connected to the lower end of said back structure and adapted to be supported on the bottom of the bathtub;

(C) said back structure including a back support section extending upwardly from said base structure, an individually inflatable head support section positioned at the top of said back support section, and an individually inflatable lateral support section at each side of said back support section extending upwardly from said base structure to said head support section;

(D) said base structure having a free end and including a seat support section adjacent the lower end of said back structure, an inflatable knee support section adjacent the free end of said base structure, and an inflatable rim section extending from said back structure along one side of said base structure, across the free end of said base structure, and back along the other side of said base structure to said back structure;

(E) said head support section including a plurality of individually inflatable portions positioned side by side at the top of said back structure; and (F) each lateral support section including a plurality of individually inflatable portions arranged serially between said base structure and said head support section.

5. An inflatable chair according to claim 4 wherein:
(G) said knee support section has a triangular configuration adapted to fit under and support the flexed knees of a user.

6. An inflatable chair according to claim 5 wherein:
(H) said chair further includes a first safety belt mounted on said back structure and arranged to extend across the chest of a user, a second safety belt mounted on said base structure and arranged to extend across the pelvic region of a user, and ankle straps mounted on the free end of said base structure adapted to embrace the ankles of a user.

7. An inflatable chair intended for use in bathing a handicapped person in a bathtub, said chair comprising:
(A) a back structure adapted to be supported against an end wall of the bathtub and having a lower end; and
(B) a base structure connected to the lower end of said back structure and adapted to be supported on the bottom of the bathtub;
(C) said back structure including a back support section extending upwardly from said base structure about an angle such that said sections generally conform to the shape of a bath tub bottom and end wall and a lateral support section at each side of said back support section each lateral support section extending upwardly from said base structure and each including a plurality of individually inflatable sections arranged serially one on top of another oriented transverse to said upward extent.

8. An inflatable chair according to claim 7 wherein:
(C) said base structure includes a seat support section adjacent the lower end of said back structure and an inflatable knee support section adjacent a free end of said base structure.

9. An inflatable chair according to claim 8 wherein:
(D) said knee support section has a triangular configuration adapted to fit under and support the flexed knees of a user.

10. An inflatable chair according to claim 9 wherein:
(E) said base structure further includes an individually inflatable U-shaped rim section extending along one side of said base structure, across the free end of said base structure, and back along the other side of said base structure to said back structure.

11. An inflatable chair according to claim 10 wherein:
(F) said seat support section is inflatable.

12. An inflatable chair according to claim 11 wherein:
(G) said seat support section includes a plurality of portions which are simultaneously inflatable.

13. An inflatable chair according to claim 7 wherein:
(C) said base structure includes a free end, said base structure includes a seat section adjacent the lower end of said back structure, an individually inflatable knee support section adjacent the free end of said base structure, and a U-shaped individually inflatable rim section extending from said back structure along one side of said base structure, across the free end of said base structure, and back along the other side of said base structure; and
(D) said back structure includes a back support section extending upwardly from said base structure, and an individually inflatable lateral support section at each side of said back support section extending upwardly from said base structure to said head support section.

14. An inflatable chair according to claim 13 wherein:
(E) said seat support section of said base structure and said back support section of said back structure are also inflatable.

15. An inflatable chair according to claim 14 wherein:
(F) said seat support section and said back support section are simultaneously inflatable.

16. An inflatable chair according to claim 7 wherein:
(D) said base structure has a free end and includes a seat support section adjacent the lower end of said back structure, an inflatable knee support section adjacent the free end of said base structure, and an inflatable rim section extending from said back structure along one side of said base structure, across the free end of said base structure, and back along the other side of said base structure to said back structure.

* * * * *